United States Patent [19]

Raine et al.

[11] Patent Number: 4,909,390

[45] Date of Patent: Mar. 20, 1990

[54] MOISTURE RESISTANT CARTON

[75] Inventors: Paul R. Raine; Paul Dunk, both of Slough, England

[73] Assignee: The Wiggins Teape Group Limited, Basingstoke, England

[21] Appl. No.: 291,761

[22] Filed: Dec. 29, 1988

[30] Foreign Application Priority Data

Jan. 4, 1988 [GB] United Kingdom ..... 8800033
Oct. 26, 1988 [GB] United Kingdom ..... 8825025

[51] Int. Cl.[4] ..... B65D 85/48

[52] U.S. Cl. ..... 206/455; 206/204; 206/449; 206/811

[58] Field of Search ..... 206/204, 425, 449, 455, 206/811; 220/416, 417

[56] References Cited

U.S. PATENT DOCUMENTS

| | | | |
|---|---|---|---|
| 1,948,593 | 2/1934 | Patterson | 206/811 |
| 1,986,057 | 1/1935 | Hackworth | 206/811 |
| 2,327,713 | 8/1943 | Hunter | 206/455 |
| 2,354,706 | 8/1944 | Rulon | 206/455 |
| 2,995,238 | 8/1961 | Casselman | 206/455 |
| 3,043,487 | 7/1962 | Fowle | 206/455 |
| 3,116,147 | 12/1963 | Uber et al. . | |
| 3,185,298 | 5/1965 | Verspecht | 206/455 |
| 3,249,033 | 5/1966 | Cobb, Jr. et al. | 206/455 |
| 3,349,221 | 10/1967 | Schulze et al. . | |
| 3,368,670 | 2/1968 | Weaver | 206/811 |
| 3,458,033 | 2/1969 | Kenji et al. | 206/455 |
| 3,463,301 | 8/1969 | Speelman | 206/455 |
| 3,556,816 | 1/1971 | Nughes | 206/811 |
| 3,608,707 | 9/1971 | Miller . | |
| 3,615,006 | 10/1971 | Freed | 206/811 |
| 3,645,388 | 2/1972 | Fessenden | 206/455 |
| 3,770,486 | 11/1973 | Hopermann . | |
| 3,810,229 | 5/1974 | Dunning et al. | 206/455 |
| 3,932,693 | 1/1976 | Shan et al. | 206/811 |
| 3,946,868 | 3/1976 | Rutter | 206/455 |
| 4,257,317 | 3/1981 | Yoshida et al. | 206/455 |

FOREIGN PATENT DOCUMENTS

| | | |
|---|---|---|
| 57-81270 | 5/1982 | Japan . |
| 58-35545 | 3/1983 | Japan . |
| 00686 | 5/1988 | PCT Int'l Appl. . |
| 1044395 | 9/1966 | United Kingdom . |
| 1313269 | 4/1973 | United Kingdom . |
| 1439104 | 6/1976 | United Kingdom . |
| 2066208 | 7/1981 | United Kingdom . |

*Primary Examiner*—David T. Fidei
*Attorney, Agent, or Firm*—Burns, Doane, Swecker & Mathis

[57] ABSTRACT

A pack of paper suitable for use in xerographic, ion deposition of magnetographic printing processes, the pack including a stack of paper sheets having a moisture content of not more than 6% and a reclosable carton made of semi-stiff sheet material and comprising a container portion containing said stack, and a closure portion, said container and closure portions having mutual parallel planar surfaces which slidably interengage upon closure of the carton to restrict air ingress to the carton there-between, and means for limiting the (WVIR) to not more than 30 grammes per square meter of the surface area of the carton in 24 hours at 90% Relative Humidity and a temperature of 32° Celsius.

9 Claims, 1 Drawing Sheet

MOISTURE RESISTANT CARTON

BACKGROUND OF THE INVENTION

This invention relates to cartons, and especially to cartons for use in the storage of stacks of paper in sheet form for use in xerographic, magnetographic, ion deposition, and especially laser xerographic imaging processes.

The conventional xerographic process for producing copies from a master on plain paper operates by forming on a suitable receptor surface an optically generated electrostatic negative image of the document to be copied, dusting the image with a fusible coloured toner, transferring the toner to form a positive image on a plain paper sheet and fusing it to the sheet by the application of heat.

The xerographic process will not operate satisfactorily with paper having too high a moisture content, and the moisture level of the paper supplied for use in the process must therefore be subject to careful control. Similar moisture constraints apply to paper for use in ion deposition or magnetographic printing processes. Typically a ream of such paper would be packed in a paper wrapping having a moisture vapour transmission rate (MVTR) of not more than 10 grammes per square metre in 24 hours to relative humidity of 90% and a temperature of 32° C.

Since such papers are used for copying at a substantial rate, and a ream of such paper, once opened, will not generally remain unused for a long period, the wrapping can generally be discarded within a short time after the pack has been opened. The resulting relatively short term exposure to ambient conditions will not generally cause excessive moisture absorption before the paper is used.

In a recent modification of the xerographic process however, the electrostatic image is not formed optically from a master, but by means of a laser driven from the memory of a computer or word processor. The laser thus reproduces as the electrostatic image the typed material contained in the memory of the machine. Laser xerographic printing can thus be substituted for impact or ink jet printing as currently used for producing hard copy derived from computers or word processors. As a result, laser xerography can be used in substitution for a conventional typewriter for printing an individual letter on preprinted letterhead paper. Unlike conventional xerography therefore, the sheets from a pack of paper will usually be fed into a laser xerographic printer intermittently and at a much lower frequency than in conventional xerography - being used by secretarial staff at substantially the same rate as in producing individual items of conventional typed correspondence.

A pack of paper of, say 500 sheets, for use in laser xerographic printing, may therefore be of much higher quality than that generally used in conventional xerographic copying, but may be used at a much slower rate, with a few sheets at a time being removed intermittently from the pack for use. Paper suitable for such use is described in copending U.S. Patent Application No. 07/295,375 (corresponding to United Kingdom Patent Applications Nos. 88 01044 and 88 17113) which require inter alia that the paper be maintained to the point of use at a moisture content below 6%.

The paper must therefore be manufactured at a moisture content in contemplation of the likely moisture take up during storage and intermediate processing, such as preprinting, and the packaging must be capable of maintaining the paper at or below the maximum permitted moisture content. At the same time, the packaging must be capable of relatively airtight reclosure after initial opening so as to minimise moisture ingress whilst in a closed condition during the possibly substantial period during which complete usage of the paper will occur. It is among the object of the present invention to provide a reclosable pack of paper intended for use in laser xerographic or similar reproduction, which affords adequate resistance to moisture ingress so as to maintain the paper in good condition in such reproduction, and which, optionally, can be repeatedly resealed.

SUMMARY OF THE INVENTION

The present invention therefore provides a pack of paper suitable for use in xerographic, ion deposition or magnetographic printing processes, said pack including a stack of paper sheets having a moisture content of not more than 6% and a reclosable carton made of semi-stiff sheet material and comprising a container portion containing said stack, and a closure portion, said container and closure portions having mutually parallel planar surfaces which slidably interengage upon closure of the carton to restrict air ingress to the carton therebetween, and means for limiting the Water Vapour Ingress Rate (WVIR) to not more than 30 grammes per square metre of the surface area of the carton in 24 hours at 90% Relative Humidity and a temperature of 32° Celsius.

DETAILED DESCRIPTION OF THE PREFERRED EMBODIMENTS

The carton itself may have the said WVIR in its closed condition, and may comprise a tray-like container portion supporting the stack of paper sheets and a closure portion formed as a lid for enclosing the stack supported on the tray portion, with both the tray and lid comprising side walls which, in the closed condition of the carton are disposed in closely juxtaposed parallel relation so as to minimise the ingress of moisture laden air. Optionally, the carton may also comprise reclosable seals formed, for example, of low tack adhesive on one surface adhesively engageable with a silicone release coating on a juxtaposed surface. The low tack adhesive may be a latex adhesive such as ethylene vinyl acetate (EVA), ethylene acrylic acid (EAA), vinyl acetate (VA) or plasticised poly(vinylchloride) (PVC). Preferably, the Water Vapour Ingress Rate (WVIR) of the closed carton is not more than 15 and optimally not more than 10 grammes per square metre of the surface area of the closed carton in 24 hours at 90% relative humidity and a temperature of 32° Celsius.

The moisture vapour ingress restriction can also be met by a combination of inner and outer packings. In this case the means for limiting the WVIR may comprise a combination of the carton in its closed condition and further packaging containing the carton. The further packaging may comprise a larger reclosable container containing two or more cartons. This is particularly advantageous where it is necessary for a number of packs of smaller quantities (eg. reams) of paper in a larger pack. Thus for example five reams of paper each packed in a reclosable carton can be collectively packed in a larger reclosable carton. It is then only necessary to ensure that the inner and outer packs meet the specified Water Vapour Ingress Rate criteria in combination.

It has been determined experimentally for example that paper manufactured at 4.7% moisture and packaged as hereinabove described will be maintained at a moisture content of below 6% for up to four months in temperate latitudes for example in the conditions typical of Western Europe, and allowing also for moisture uptake from possible intermediate preprinting, for example of letterhead office stationery.

A number of semi-stiff materials may be used to form the carton or cartons. Thus polyolefin (polyethylene or polypropylene) coated cardboard or metal foil laminated board have been found to be suitable. Micro-corrugated board sold under the trade name Chiltect, which incorporates a polyethylene insulating surface lining, has also been found to be especially suitable for use in manufacturing larger cartons for the collective packaging of a number of separate ream packs.

In order to test a filled carton in order to determine the Water Vapour Ingress Rate, the following procedure was adopted.

1. The carton is filled to its normal fill level with paper sheets having a known moisture content.

2. The external dimensions of the closed carton are measured and the surface area calculated.

3. The carton is supported by point supports at the corners in a test chamber maintained at 90% relative humidity (±2%) and 32° C. (±1° C.).

4. At intervals of 24 hours, sheets of paper are removed from a number of positions in the stack of paper contained in the carton and the moisture content of such sheets is determined gravimetrically, for example by a precalibrated moisture meter sold under the trade name "Moistrex" by Infra Red Engineering Limited.

5. The moisture pick up during each sequential period of 24 hours is calculated with reference to the known weight of paper in the carton and is expressed as grammes per 24 hours.

6. The mean daily moisture increase is determined graphically from a linear regression plot of % moisture increase against time periods of 24 hours.

7. The Water Vapour Ingress Rate can then be calculated in grammes per square metre of the surface area of the carton in 24 hours at 90% Relative Humidity and 32° Celsius.

The invention will now be further described with reference to the accompanying drawings and is also illustrated by the following Examples. In the drawing.

Figure 1:
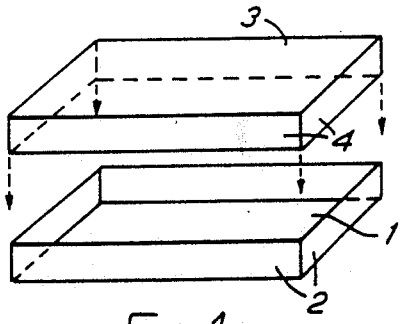
FIG. 1 is a perspective view of one carton according to the invention.

The carton shown in FIG. 1 consists of a tray portion 1 having side walls 2 dimensioned to receive a ream of A4 size (210 mm×297 mm) paper and a cover 3 having side walls 4 which are a sliding fit over the side walls 2 of the tray portion.

Figure 2:
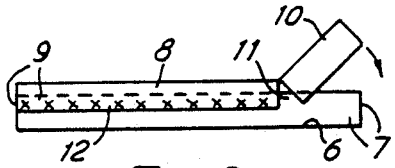
FIGS. 2, 3, 4 and 5 are side elevations of four further forms of carton according to the invention.

The carton of FIG. 2 consists of a tray portion 6 having side walls 7 and a cover portion 8 having side walls 9. The cover portion 8 has an end section 10 defined by cuts 11 in the side walls 9 so that it can be swung upwardly as indicated by the arrow. The remaining portions of the side walls 9 are adhered by a permanent adhesive 12 to the side walls 7 of the tray 6. The closed carton can then be opened by raising the end section 10 of the cover 8, and then reclosed by lowering the section 10 after the necessary paper has been removed.

Figure 3:
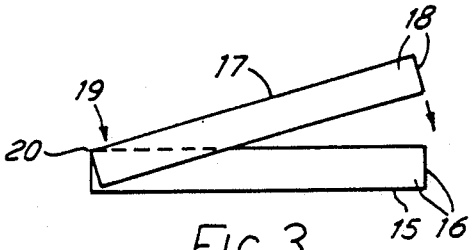

FIG. 3 shows a carton having a tray section 15 having side walls 16 and a cover portion 17 having side walls 18. At one end 19, the side wall 18 is omitted and the cover connected to a side wall 16 of the tray 15 so as to be hingeable about the upper edge 20. The cover 17 can thus be opened by pivoting about the edge 20 to access a ream of paper packed in the carton.

Figure 4:
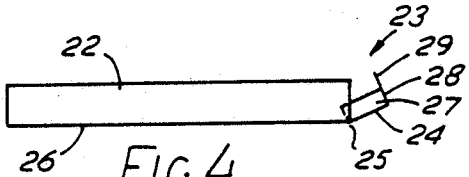

FIG. 4 shows a carton comprising a box 22 which is completely sealed except at one end 23. At the end 23, an end wall 24 is hinged at one edge 25 to the end of the lower face 26 of the box. The end wall 24 has side walls 27 and a top wall 28 from which a tongue 29 extends. In use, the end wall 24 is pivoted downwardly about the edge 25 to permit removal of the requisite number of sheets from the carton. Reclosure is effected by tucking the tongue 29 into the carton as the end wall 24 is pushed in until the end wall lies at right angles with the lower face 26 of the box. In this position, the end of the stack of paper is enclosed by the walls 27 and 28 as well as the tongue 29 of the end wall 24.

Figure 5:
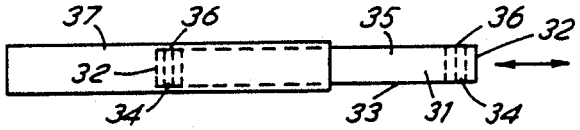

Turning now to FIG. 5, this shows a carton having a tray portion 31 having end walls 32 formed by doubling extensions of the base 33 of the carton over inwardly folded tongues 34 extending from the side walls 35. This formation produces an advantageous stiffening in the end walls 32 whilst also presenting short planar surfaces 36 at their upper edges. The tray portion 31 slidably engages in a sleeve portion 37 so that when the carton is closed, the planar surfaces 36 slidably engage against the inner surface 38 of the sleeve 37 to limit the ingress of moisture laden air.

The various forms of carton shown in FIGS. 1 to 5 are made of board having enhanced moisture resistance. Thus for example card 650 microns thick laminated to aluminium foil has been found to perform satisfactorily, as has similar card laminated to high density or low density polyethylene film 25 microns thick.

Figure 6:
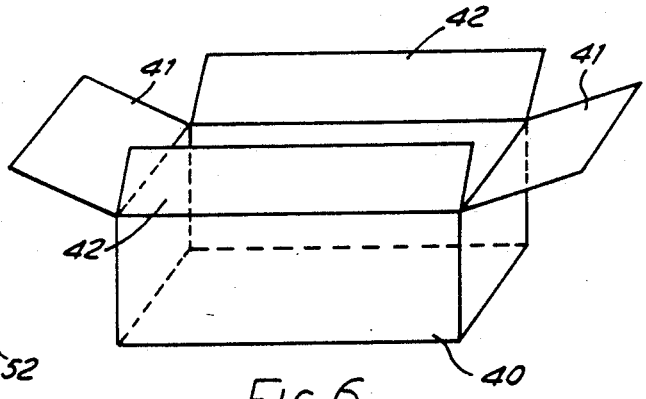
FIG. 6 is a perspective view of a sixth form of carton according to the invention.

FIG. 6 shows a larger form of carton suitable for packing multiples of cartons of the kinds described above with reference to FIGS. 1 to 5. The carton shown in FIG. 6 comprises a deep tray portion 40 having end closure flaps 41 and side closure flaps 42. The carton shown in FIG. 6 is preferably made from a moisture resistant board such as that sold under the trade name Chiltect, which comprises microcorrugated board having laminated thereto a polyethylene surface lining.

Figure 7:
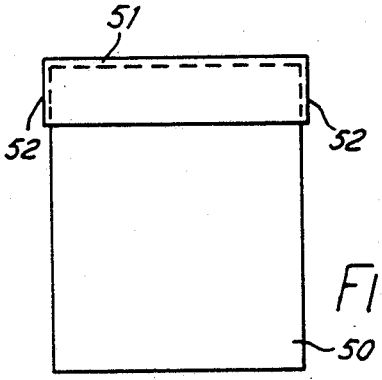
FIG. 7 is an end elevation of a seventh form of carton according to the invention.

FIG. 7 shows another form of carton which can be used as an outer packing for multiples of the kind of carton shown in FIGS. 1 to 5. The carton of FIG. 7 comprises a deep tray portion 50 and a lid portion 51 having side walls 52 which form a close sliding fit over the upper part of the tray portion 50. The carton shown in FIG. 7 is also preferably made of moisture resistant board such as that described above with reference to FIG. 6.

EXAMPLE 1

A carton as described above with reference to FIG. 1 was constructed from cardboard 650 microns thick and having aluminium foil laminated to one surface.

500 sheets (one ream) of A4 paper having a substance of 90 grammes per square metre and a moisture content of 4.7% was enclosed in the carton.

The carton was then subjected to the Water Vapour Ingress Rate test procedure described above and the WVIR determined as being 15.5 grammes per square metre of the surface area of the carton in 24 hours at 90% Relative Humidity and 32° Celsius.

When a similarly packed carton was exposed in a warehouse for 3 months in the southern part of the United Kingdom, the increase in moisture content of the paper was found to be 0.67% to 5.4%, and therefore well below 6%. For comparison, a similarly packed carton made of conventional cardboard, was subjected to simultaneous exposure in the same warehouse. In this case the increase in moisture content in the paper was found to be 1.8%, to an unacceptably high 6.5%.

EXAMPLE 2

The procedure of Example 1 was repeated, but using card having laminated thereto a film of High Density Polyethylene 25 microns thick. The WVIR was found to be 29.5 grammes per square metre of the surface area of the carton in 24 hours at 90% Relative Humidity and 32° Celsius. The moisture increase in the paper resulting from warehouse exposure was 0.73% to 5.43%.

The paper in the carton was then printed for use as letterhead stationery and was found to have increased in moisture content by a further 0.5% to 5.93%, thus still remaining below 6%.

EXAMPLE 3

The procedure of Example 2 was repeated, but using card having laminated thereto a Low Density Polyethylene film 25 microns thick. The results were identical to those described in Example 2.

EXAMPLE 4

A large carton was constructed as described above with reference to FIG. 7. Five reams of 500 sheets of A4 paper having a substance of 90 grammes per square metre and a moisture content of 4.7% were packed in cartons of the configuration shown in FIG. 1, but made of conventional cardboard. The five packaged reams were enclosed in the large carton, the large carton then subjected to the WVIR test as described above. The Water Vapour Ingress Rate was found to be 20.5 grammes per square metre of the surface area of the large carton in 24 hours at 90% Relative Humidity and 32° Celsius. The take up of moisture by the paper after subjection to the warehouse conditions specified in Example 2 was found to be 1.04%.

EXAMPLE 5

Example 4 was repeated but using five reams of paper packed as described above with reference to FIG. 1. The Water Vapour Ingress Rate was found to be 12.7 grammes per square metre of the surface area of the large carton in 24 hours at 90% Relative Humidity and 32° Celsius. The take up of moisture by the paper after subjection to the warehouse conditions specified in Example 4 was found to be 0.45%.

We claim:

1. A pack of paper suitable for use in xerographic, ion deposition of magnetographic printing processes, the pack including a stack of paper sheets having a moisture content of not more than 6% and a reclosable carton made of fibrous board material, including means for enhancing the moisture resistance thereof and selected from the group consisting of cardboard, laminated board and microcorrugated board, said carton comprising a container portion containing said stack, and a closure portion, said container and closure portions having mutual parallel planar surfaces which slidably interengage upon closure of the carton to restrict air ingress to the carton there-between, whereby, in the closed condition, the carton has a water vapor ingress rate of not more than 30 grams per square meters of the surface area of the carton in 24 hours at 90% Relative Humidity and a temperature of 32° Celsius.

2. A pack as claimed in claim 1, in which the carton has a tray-like container portion supporting the stack of paper sheets and a closure portion formed as a lid for enclosing the stack supported on the tray portion, with both the tray and lid comprising side walls which, in the closed condition of the carton are disposed in closely juxtaposed parallel relation so as to minimise the ingress of moisture laden air.

3. A pack as claimed in claim 1, in which the carton comprises reclosable seals.

4. A pack as claimed in claim 3, in which the reclosable seals are formed of low tack adhesive on one surface adhesively engageable with a silicone release coating on a juxtaposed surface.

5. A pack as claimed in claim 1, in which the water vapor ingress rate of the closed carton is not more than 15 grammes per square metre of the surface of the closed carton in 24 hours at 90% relative humidity and a temperature of 32° Celsius.

6. A pack as claimed in claim 1, in which the water vapor ingress rate of the closed carton is not more than 10 grammes per square metre of the surface of the closed carton in 24 hours at 90% relative humidity and a temperature of 32° Celsius.

7. A pack as claimed in claim 1, in which the means for limiting the water vapor ingress rate comprise a combination of the carton in its closed condition and further packaging containing the carton.

8. A pack as claimed in claim 7, in which the further packaging comprises a larger reclosable container containing at least two cartons.

9. A pack as claimed in claim 1, in which the carton is formed from a member of the group consisting of polyolefin coated cardboard, metal foil laminated board, and micro-corrugated board incorporating a polyethylene insulating surface lining.

* * * * *